United States Patent [19]

Tucker et al.

[11] Patent Number: 4,828,178

[45] Date of Patent: May 9, 1989

[54] METHOD AND APPARATUS FOR DISPERSING LIQUIDS OR MELTS

[75] Inventors: Richard O. Tucker, Oakboro; Richard D. Rierson, Jr., Charlotte, both of N.C.

[73] Assignee: Hoechst Celanese Corporation, Somerville, N.J.

[21] Appl. No.: 68,488

[22] Filed: Jun. 29, 1987

[51] Int. Cl.[4] ..... B05B 3/10

[52] U.S. Cl. ..... 239/223; 239/390; 239/553; 239/559

[58] Field of Search ..... 239/223, 224, 390, 391, 239/397, 558, 559, 553, 76, 553.3, 553.5

[56] References Cited

U.S. PATENT DOCUMENTS

| | | | |
|---|---|---|---|
| 1,506,226 | 8/1924 | Dick | 239/224 |
| 2,515,665 | 7/1950 | Pieper | 239/223 |
| 3,719,168 | 3/1973 | Kazee | 239/223 |
| 4,313,394 | 2/1982 | North et al. | 239/223 |

FOREIGN PATENT DOCUMENTS

| | | | |
|---|---|---|---|
| 386681 | 9/1973 | U.S.S.R. | 239/223 |

*Primary Examiner*—Andres Kashinikow
*Assistant Examiner*—Karen B. Merritt
*Attorney, Agent, or Firm*—Forrest D. Stine

[57] ABSTRACT

An improved method and apparatus for producing an disbursing uniform liquid or melt droplets employing a core-fed rotating sprayer having multiple tiers of orifices.

7 Claims, 3 Drawing Sheets

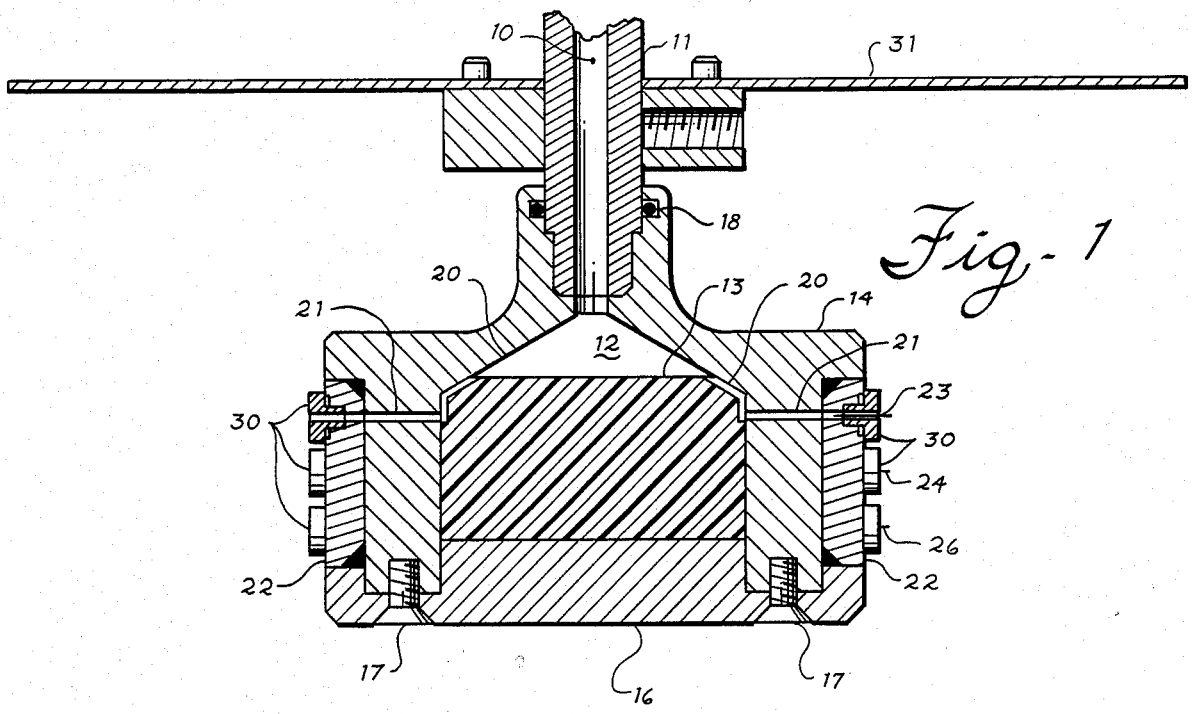
Fig. 1
Fig. 6
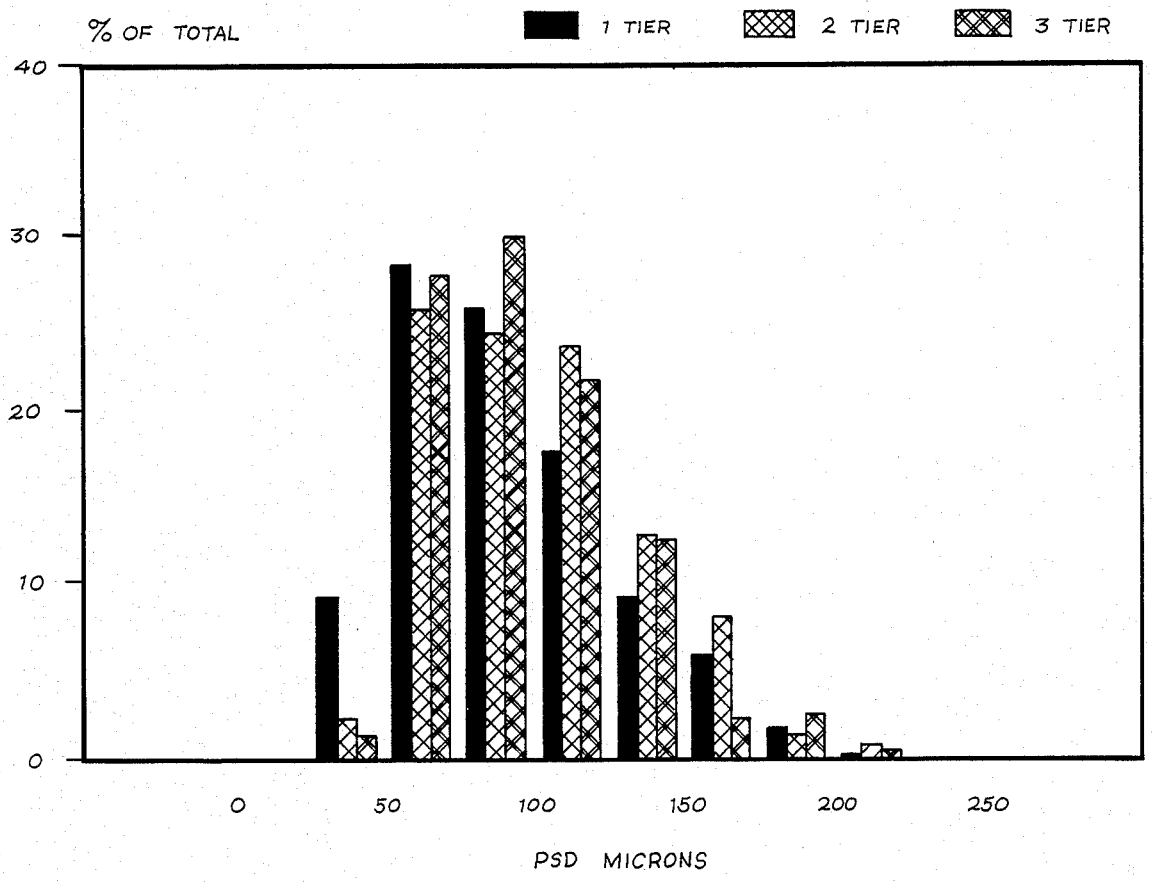

METHOD AND APPARATUS FOR DISPERSING LIQUIDS OR MELTS

This invention relates to an improved rotating core-fed, high volume sprayer and method for dispersing liquids or melts. Particularly adapted to produce polybenzimidazole microspheres, the sprayer contains a distributor for channeling liquids or melts to multiple tiers of orifices.

BACKGROUND OF INVENTION

In the production of polybenzimidazole (PBI) particles from a solution of the PBI polymer, the solution is pumped through multiple orifices into air and directed into a coagulant or non-solvent for the polymer. When employing conventional sprayers, the formed particles are irregular in shape, have a large or unacceptable particle size distribution, and have a non-uniform interior surface due to air inclusion.

Further, if the extrusion orifices of the conventional sprayer are arranged in tiers, the particle size distribution of the formed particles is substantially increased due to the uneven and lesser rate of flow of the solution through the orifices of the upper tier as compared to the solution flow through the orifices of the lower tier. Moreover, the size of the orifices of conventional sprayers cannot be readily adjusted to provide a controlled particle size distribution.

SUMMARY OF INVENTION

By the invention a rotating, core-fed sprayer having multiple tiers of readily adjustable orifices for the uniform extrusion of liquids or melts is provided. The sprayer contains distribution means for channeling controlled amounts of vapor-free liquids or melts through multiple tiers of orifices and is particularly adapted to produce uniform PBI microspheres.

BRIEF DESCRIPTION OF THE DRAWINGS

FIG. 1 is a cross-sectional view of that portion of the rotating sprayer assembly containing the liquid or melt distribution means and multiple-tiered orifices of the invention.

FIG. 6 demonstrates the effectiveness of the invention to obtain controlled sizing of PBI particles.

DESCRIPTION OF PREFERRED EMBODIMENT

Figure 3:
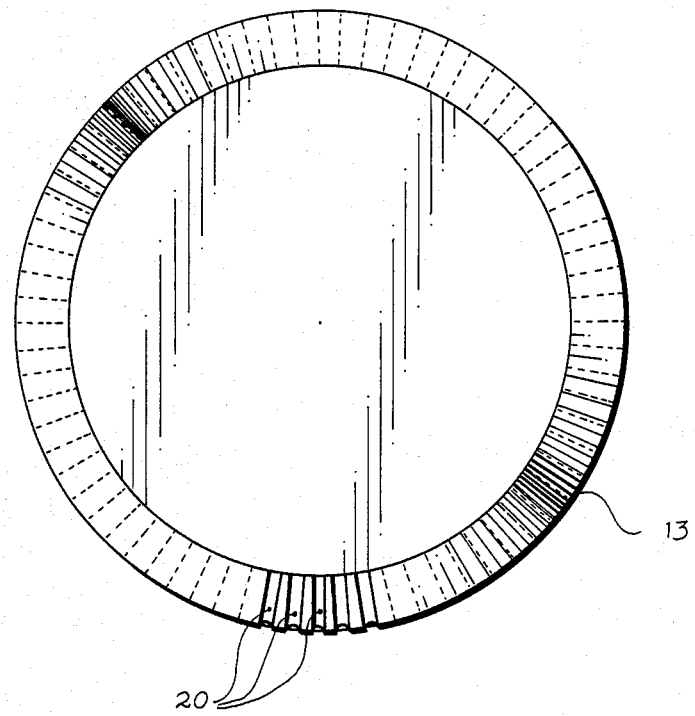
FIG. 3 is a top view of the distributor showing the distribution channels of FIG. 2.

Referring to FIG. 1, the sprayer comprises a conventional means, not shown, for passing a liquid or melt under pressure to the center channel 10 of rotating shaft 11. Shaft 11 is connected to a conventional means such as a gear or belt for rotating shaft 11, preferably at adjustable speed.

The liquid or melt is introduced through channel 10 into a chamber 12 formed by distributor 13 and upper circular disc member 14. Distributor 13 is maintained in fixed relationship to upper disc member 14 by means of a lower circular disc member 16, screw members 17, and by an alignment procedure subsequently described.

Although not to be limited thereto, shaft 11 can be a hollow metal shaft formed from a material such as stainless steel. Upper and lower disc members 14 and 16 can also be fabricated of stainless steel or other suitable metals. Upper disc member 14 can be maintained in threaded relationship to shaft 11 and a sealing means such as an O-ring 18 employed.

Figure 2:
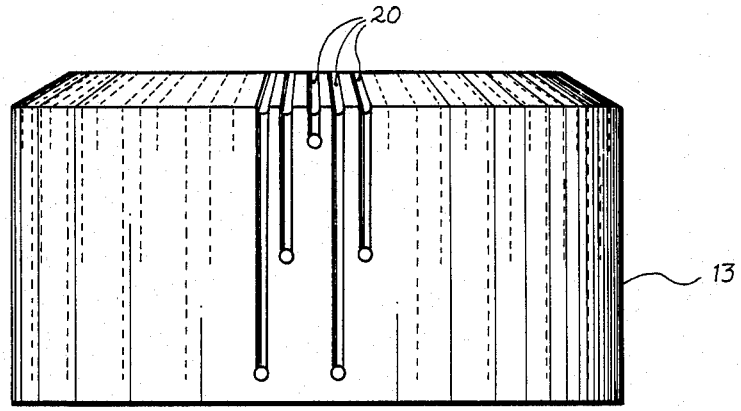
FIG. 2 is a vertical partial cross-sectional view of the distributor.
Figure 5:
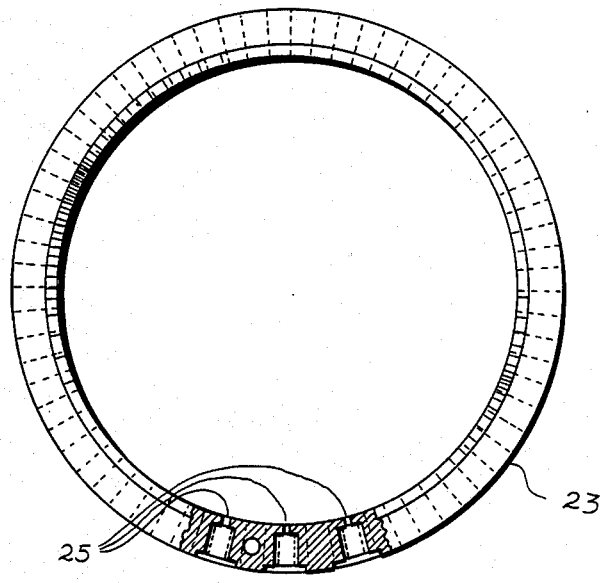
FIG. 5 is a top view partially in cross-section of the orifice ring of FIG. 4.

The liquid or melt passes from chamber 12 through channels 20 positioned as shown on the surface of distributor 13 (FIGS. 2 and 3). A separate channel 20 communicates between chamber 12 and each passage 21 positioned in disc member 14 (FIG. 1). The cross sectional area of each channel 20 is controlled so as to deliver the desired rate of flow of liquid or melt adjacent the interior wall of disc member 14 to a passage 21. Assuming that the flow rate to each orifice passage 21 in each tier is to be constant, the cross-sectional area of each channel 20 will be directly proportional to the length of the channel 20. Those channels 20 communicating with passages 21 in the upper tier 23 (FIG. 4), for example will have a cross-sectional area approximately one-half that of the channels 20 communicating with lower tiers 24 and 26 if it is desired to pass a liquid or melt at a constant rate through passages 21 of each tier.

Figure 4:
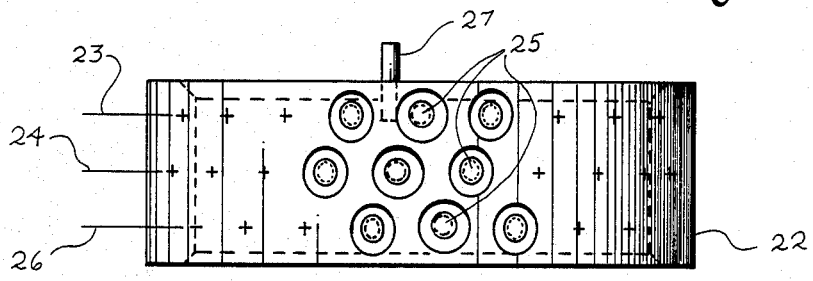
FIG. 4 is a vertical view of the orifice ring showing in partial detail the multiple tiered orifice channels.

Circular passages 21 communicate between channels 20 and orifice outlets 25 positioned in orifice ring 22. Orifice ring 22 is slidably positioned adjacent disc member 14 by removable lower disc member 16 and screw members 17. Alignment of passages 21 with orifice inlets 25 is accomplished by a dowel pin 27 being inserted into a recess in disc member 14. By employing tiers of orifices as illustrated in FIG. 4, it is possible to substantially increase the production of uniform PBI particles while maintaining proper spacing between orifices to avoid agglomeration of droplets or melt being extruded or sprayed. Orifice ring 22 can be fabricated from stainless steel or other suitable metals.

Screw threads are employed to position orifices 30 within orifice ring 22. Particles of varying size can be obtained by employing orifices of varying size which can be individually installed in orifice ring 22 in the assembled sprayer or after removal of the orifice ring 22.

Distributor 13 is positioned within chamber 12 so as to align each channel 20 with its corresponding passage 21. This alignment can be accomplished by inserting distributor 13 into chamber 12 in accordance with indexing marks positioned on the bottom of distributor 13 and on the bottom of upper disc member 14. Final alignment is achieved by inserting at least one removable pin through a hole previously drilled through the side wall of upper disc member and into a guide recess previously formed in distributor 13.

Although distributor 13 can be fabricated from metals it is preferred that a plastic material such as a tetrafluoroethylene resin or Teflon can be employed. This resin is of sufficient strength to permit machining the surface in the formation of channels 20 of a precise cross-section. It is necessary that distributor 13 be positioned immediately adjacent the inner surface of upper disc member 14 so as to prevent leakage or uncontrolled flow from chamber 12 to passages 21.

By employing a resin, distributor 13 can be sized to prevent the above-described leakage and placed in liquid nitrogen to reduce its size temporarily. The cooled distributor 13 is then inserted into chamber 12 and the close fit obtained as distributor 13 heats to ambient temperature and expands.

A fan 31 is optionally positioned as shown on shaft 11. The fan acts to channel the flow of liquid or melt extruded from orifices 30 downward to a receiving vessel or coagulant when the sprayer is employed to obtain uniform PBI particles as subsequently described.

The rotating sprayer is particularly effective in the production of PBI microspheres having a particle size distribution ranging from 50 to 500 microns. In producing such microspheres, a solution of the PBI can be prepared employing a solvent selected from the group consisting of N,N-dimethylacetamide, N,N-dimethylformamide, N-methylpyrrolidone, dimethyl sulfoxide and other polar aprotic solvents. The concentration of the PBI polymer in the solvent will normally range from 5 to 14 weight percent.

The PBI solution or dope can be pumped through channel 10 of the sprayer as previously described with said sprayer being positioned so that channel 10 is positioned vertically. The solvent stream exiting the orifices 25 into the air becomes unstable and develops a sinous wave, the frequency of which is determined by the centrifugal force exerted on the solvent stream, the polymer viscosity and the air turbulence. Droplets are formed which become spherical due to surface tension.

The liquid droplets are quenched with a non-solvent for the PBI to produce the solid microspheres. Suitable non-solvents include aliphatic alcohols having 1 to 4 carbon atoms, of which methanol is preferred. Typically, the PBI dope is sprayed so as to permit the formed droplets to fall into a bath of the non-solvent positioned from 12 to 30 inches below the sprayer.

In order to demonstrate the effectiveness of the invention, a dimethylacetamide solution containing 14.0 weight percent PBI polymer was prepared. The prepared solution was pumped to center channel 10 of the rotating sprayer containing three tiers of orifice outlets 25, each tier containing 24 outlets with each outlet having a diameter of 0.0135 in. The sprayer was rotated at a speed of 3600 rpm and the dope or solution was passed to the sprayer at a rate such that the dope rate constant was 5.82. The dope rate constant is the grams per minute of dope multiplied by the total orifice cross-sectional area in square inches times $10^3$.

The droplets exiting the sprayer were permitted to fall through the air into a methanol bath maintained at room temperature. The particle size distribution of the solid PBI microspheres produced in the bath are shown in FIG. 6. Substantially identical particle size distribution is obtained in each tier, beginning with the first or lower tier and extending through the most upper or third tier. There was essentially no agglomeration of particles in the product.

The following examples are presented to illustrate the invention:

EXAMPLE 1

In this example, a dimethylacetamide solution containing 14.0% polymer was prepared. The solution or dope also containing 0.8 gram lithium chloride was pumped to the sprayer of FIG. 1 by means of a constant delivery gear pump at a rate of 20 grams per minute. The sprayer of FIG. 1 was modified so as to permit flow only through the bottom tier of orifices, each orifice having an inside diameter of 0.0135 inch.

The dope or solution was pumped through each orifice at a rate of 0.833 gram per minute and the sprayer was rotated at a speed of 3600 rpm. The aerosol of PBI droplets formed were precipitated and collected in a bath of methanol. The spherical, microporous product was separated from the solvent rich methanol by filtration and washed with water to remove residual dimethyl-acetamide. The product had particle size diameters in the range of 50–150 microns with the particle size measurement and statistics listed below in Table 1.

TABLE 1

| Run Number | Mean Particle Diameter (Microns) | Standard Deviation | Variability Coefficient (%) |
|---|---|---|---|
| 1 | 91 | 35.90 | 39.66 |
| 2 | 82 | 35.75 | 43.77 |
| 3 | 104 | 39.86 | 38.22 |
| 4 | 97 | 29.20 | 30.11 |

The standard deviation determination as employed above and in subsequent Examples estimates the range of particle sizes. In any system where randomness is observed, it is useful to model the outcomes of measurements of a given property such as particle size and then apply the model as a predictor of the future behavior of that property. Typically such systems exhibit, after a number of observations, a most common value for the measurement about which there may be either systematic or random variations. With a finite number of observations, the mean value is useful as an estimate of the true mean value for the entire population, which quite often cannot be sampled. While the mean indicates the "position" of the population, the standard deviation estimates the "spread" of the population. Sample variance about a sample mean is calculated as the sum of the squared differences between individual values and the sample mean, normalized by one less than the number of sample observations. The differences are squared since the sum of both positive and negative variations from the sample mean would yield a trivial, zero result. Since the sample is not based upon the entire population, one less than the number of observations is used as the normalizer rather than the number of observations to reduce the bias caused by the difference between the sample mean and the true mean. The sample standard deviation is merely the square root of the sample variance and is usually more useful when compared with the values of individual observations. The variability coefficient is the sample standard deviation normalized by the sample mean.

EXAMPLE 2

The run conditions of Example 1 were repeated with the exception that a second row of orifices was added and the dope rate flow increased to 40 grams per minute so as to maintain the 0.833 gram per minute orifice flow rate of Example 1. Under these conditions, steady operation could not be maintained and the sprayer produced a wide particle size distribution range. Intermittent flow from the first and second tiers was observed, indicating unequal distribution of dope flow.

EXAMPLE 3

In this Example the effectiveness of distributor 13 was demonstrated. The process run conditions of Example 2 were repeated after insertion of the distributor 13 which divided the dope supply into equal streams for each orifice. The resulting product spheres had a nominal diameter size range of 50–150 microns and were essentially equivalent to those produced by the single tier operation of Example 1. The mean PBI particle size was 101 microns with a standard deviation of 34.87 and variability coefficient of 34.47.

EXAMPLE 4

The process run of Example 3 was repeated with the exception that a third tier of 0.0135 inch orifices were added to the sprayer and the dope flow rate was increased to 60 grams per minute, maintaining the 0.833 gram per minute orifice flow rate employed in Examples 1–3. As in Example 3, distributor 13 was employed to feed the dope or solution to the three tiers of orifice holes.

Under the process conditions of this Example 3, the sprayer operated steadily and produced microspheres equal to those produced by the single tier operation of Example 1 and the double tier operation of Example 3. The mean particle size diameter of the produced PBI microspheres for the 72-hole operation of this Example 4 was 97, the standard deviation was 32.23 and the variability coefficient was 33.25.

The invention has been described in considerable detail with particular reference to certain preferred embodiments thereof. However, variations and modifications can be effected within the spirit and scope of the invention as described hereinbefore, and as defined in the appended claims.

We claim:

1. In a rotating sprayer comprising a hollow-rotatable shaft communicating between a conduit means for introducing a liquid or melt into said shaft and a chamber, means for rotating said shaft, and multiple orifice means communicating between said chamber and the exterior of said sprayer, the improvement which comprises channel means positioned within said chamber for distributing said liquid or melt uniformly to said orifice means arranged in multiple tiers, said channel means comprising multiple individual channels each communicating with an orifice, the cross-sectional area of each such channel being directly proportional to the length of the channel.

2. The sprayer of claim 1 wherein each of said channels is in fixed relationship to the other channels on the surface of a distributor means positioned within said chamber.

3. The sprayer of claim 2 to include means for separately adjusting the size of each orifice.

4. The sprayer of claim 2 wherein each of said channels is adjacent the interior wall of said chamber.

5. The sprayer of claim 4 wherein said means for distributing is fabricated from a polymeric resin.

6. The sprayer of claim 5 wherein said polymeric resin is polytetrafluoroethylene.

7. The sprayer of claim 1 wherein said orifices are arranged in three tiers.

* * * * *